US010646733B2

(12) United States Patent
Ecker et al.

(10) Patent No.: US 10,646,733 B2
(45) Date of Patent: May 12, 2020

(54) FALL PROTECTION MODULAR RIGID RAIL SYSTEM

(71) Applicant: MODULAR FALL PROTECTION CONCEPTS, LLC, Wheat Ridge, CO (US)

(72) Inventors: Tim Ecker, Arvada, CO (US); Dan Henn, Spring Branch, TX (US); William Hasse, Denver, CO (US); William Parsons, St. John's (CA)

(73) Assignee: MODULAR FALL PROTECTION CONCEPTS, LLC, Wheat Ridge, CO (US)

( * ) Notice: Subject to any disclaimer, the term of this patent is extended or adjusted under 35 U.S.C. 154(b) by 0 days.

(21) Appl. No.: 15/994,758

(22) Filed: May 31, 2018

(65) Prior Publication Data

US 2018/0345057 A1 Dec. 6, 2018

Related U.S. Application Data

(60) Provisional application No. 62/514,410, filed on Jun. 2, 2017.

(51) Int. Cl.
*A62B 35/00* (2006.01)
*A62B 35/04* (2006.01)

(52) U.S. Cl.
CPC ..... *A62B 35/04* (2013.01); *A62B 35/0062* (2013.01); *A62B 35/0081* (2013.01); *A62B 35/0087* (2013.01)

(58) Field of Classification Search
CPC ..... A62B 35/0062; E04G 21/3295; A47F 5/0838; B60R 2011/0028; F16L 3/24
USPC ..... 248/317, 323, 339, 340, 220.21, 220.22, 248/225.11; 182/3, 12, 36, 113
See application file for complete search history.

(56) References Cited

U.S. PATENT DOCUMENTS

| | | | | |
|---|---|---|---|---|
| 5,924,260 | A * | 7/1999 | Austin | E04B 1/4107 403/363 |
| 6,269,904 | B1 * | 8/2001 | Morhaus | A62B 35/0087 182/36 |
| 7,603,952 | B2 * | 10/2009 | Vetesnik | A62B 35/0056 104/106 |
| 9,038,344 | B2 * | 5/2015 | Mayer | E04B 9/247 52/506.05 |
| 10,093,328 | B2 * | 10/2018 | Liggett | B61H 9/02 |
| 10,213,699 | B2 * | 2/2019 | Liggett | B61B 3/00 |
| 2008/0023267 | A1 * | 1/2008 | Small | A62B 35/0087 182/36 |
| 2013/0327591 | A1 * | 12/2013 | Galpin | A62B 35/0081 182/3 |
| 2016/0312481 | A1 * | 10/2016 | Nitis | E04G 3/22 |

* cited by examiner

*Primary Examiner* — Steven M Marsh
(74) *Attorney, Agent, or Firm* — Sandberg Phoenix & von Gontard, P.C.

(57) ABSTRACT

A rigid rail assembly for a fall protection system comprises a rigid rail segment and a hanger. The rail segment comprises an upper portion defining an elongate slot and a lower portion. The hanger includes a hanger body adapted to be connected to a support member and a hanger coupling member extending downwardly from said hanger body and which is adapted to be received in the rail segment slot. The rail segment lower portion has opposed elongate side walls extending downwardly and outwardly and a flange extending inwardly from each of said side walls. The flanges define a track for the wheels of a trolley.

20 Claims, 9 Drawing Sheets

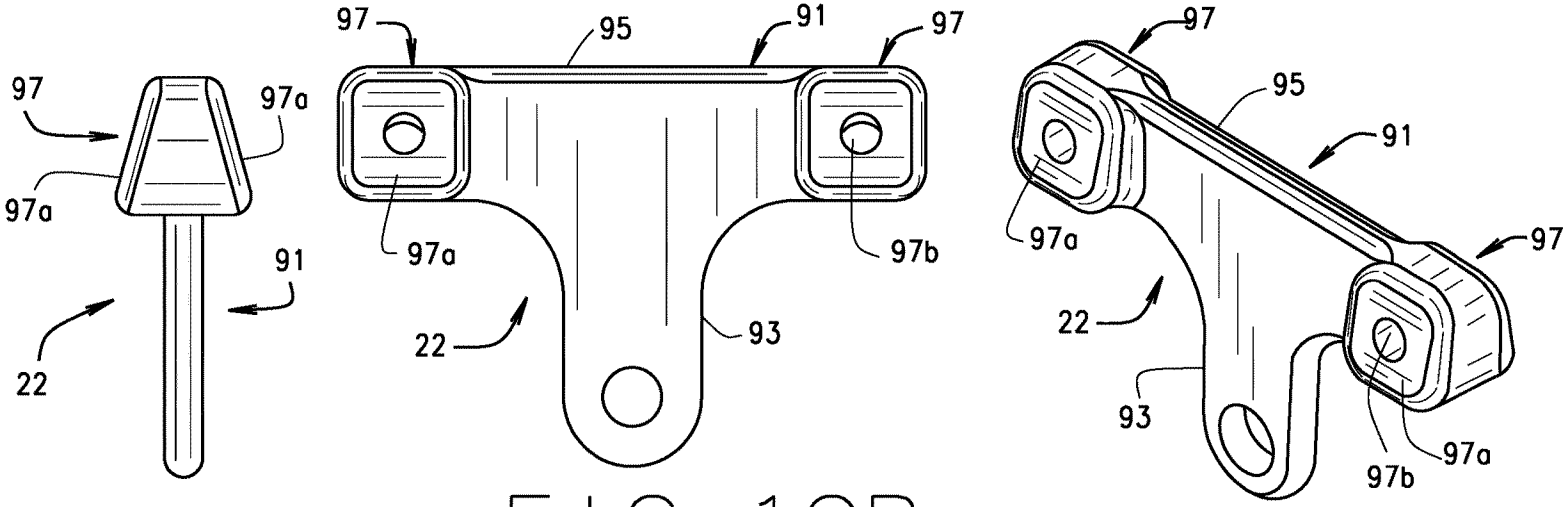
FIG. 10A
FIG. 10B
FIG. 10C
FIG. 11A
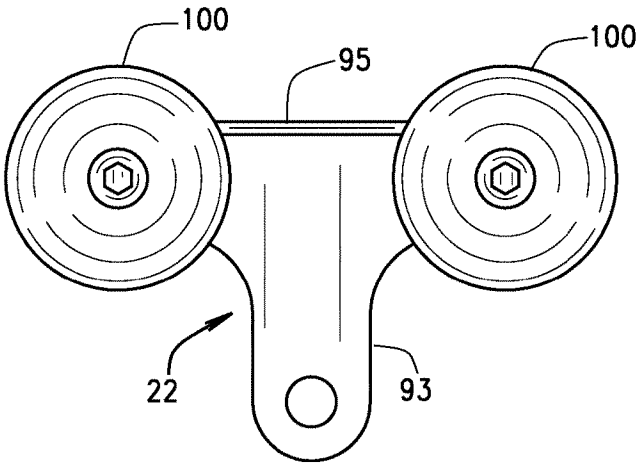
FIG. 11B
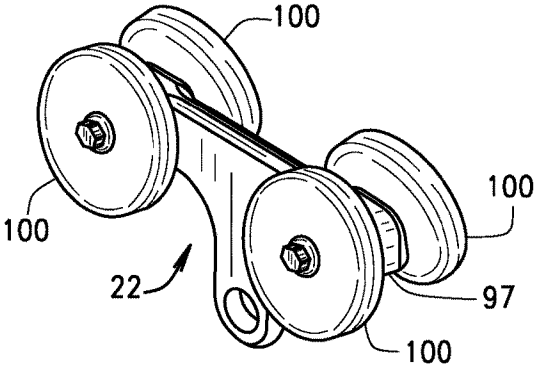
FIG. 11C

FALL PROTECTION MODULAR RIGID RAIL SYSTEM

CROSS-REFERENCE TO RELATED APPLICATIONS

This application claims priority to U.S. App. No. 62/514,410 filed Jun. 2, 2017, and which is incorporated herein by reference.

STATEMENT REGARDING FEDERALLY SPONSORED RESEARCH OR DEVELOPMENT

Not Applicable.

BACKGROUND

This application relates to a modular rigid rail for a fall protection system.

Workers who work on elevated structures are connected to an anchor by means of a lanyard to protect them in the event of a fall. The lanyard can be connected to a fixed point, which will limit the extent to which the worker can move, or to a trolley which will allow the worker to move along an elongate structure, such as a rail car. The trolleys ride along either a cable or a rigid rail. The advantages of connecting the lanyard to a rigid rail over a fixed point include the following:

- Rigid rails systems are mounted overhead and feature minimal deflection characteristics so as to limit total arrest distance and the impact effects felt by the user in a fall.
- The rigid rail acts as a conduit for a trolley, allowing users' anchor points to track or follow their movements as they traverse the area adjacent to the fall hazard.
- Rigid rail systems used in conjunction with self-retracting lanyards further limit the fall arrest distances by way of their automatic functions and locking efficiency of self-retracting lanyards.
- The elements of a rigid rail system are typically fastened to a structural element in a manner such that resulting fall arrest loads are transmitted and shared among at least two structural anchor points. These fall arrest loads are further diminished by the efficiency of the self-retracting lanyard's energy absorbing mechanism as well as minor deflection or deformation in the rail element itself.

Current rigid rail systems commonly utilize rails formed from low-carbon steel on a rolling mill. The rails are then incorporated into a truss assembly in order to achieve resistance to permanent deformation under load. While such rigid rail systems will stop a worker's fall, the rails do not dynamically deflect, and thus do not act to diminish the forces felt by the worker in a fall. Further, truss supported rigid rail systems are labor and time intensive to install, and therefore are expensive to manufacture and install.

BRIEF SUMMARY

Disclosed is a modular rigid rail system comprised of extruded rail segments, extruded connectors, hangers, and a trolley to which the lanyard is connected and which rides along the rail. The rails and the connectors are formed from a high-strength aluminum alloy and will dynamically deflect in a fall situation. The aluminum alloy allows the rail segments to be strong, yet light weight and allows the rail segment to absorb energy in a fall situation, to thereby diminish some of the forces transmitted to the worker in a fall.

In accordance with one aspect of the fall protection system, the rail segments of the rigid rail fall protection system comprise an upper portion and a lower portion. The rail segment upper portion defines an elongate slot comprised of an inner portion and an opening from a top surface of the rail segment into the inner portion; the slot inner portion having a width greater than the width of the opening. The lower portion comprising opposed elongate side walls extending downwardly and outwardly from the upper portion and a flange extending inwardly from each of the side walls. The inner ends of the flanges are spaced from each other to define an opening into an area defined by the side walls, upper portion and flanges. Each flange has an upper surface defining a channel, and the channels of the flanges are substantially parallel to each other.

In a version of the rail segment, the rail segment can include a central portion between the upper and lower portions. The central portion comprises opposed walls which extend down from the upper portion, and a bottom extending between bottom edges of the middle portion walls. In this version, the lower portion walls of the rail segment extend from the bottoms of the middle portion walls.

In accordance with an aspect of the fall protection system, the cross-sectional profile of the rail segment provides sufficient rigidity to the rail assembly, such that the rail assembly can be used without a truss assembly.

In accordance with an aspect of the rigid rail system the rail segment is made from a material, such that the rail segment will dynamically deflect under the forces of a fall. For example, the rail segment can be made from an aluminum alloy.

In accordance with an aspect of the fall protection system, the fall protection system is made from a rigid rail assembly comprised of a rail segment and a hanger:

In accordance with an aspect of the fall protection system, the rail segment comprises an upper portion and a lower portion. The rail segment upper portion defines an elongate slot comprised of an inner portion and an opening from a top surface of the rail segment into the inner portion; wherein the slot inner portion has a width greater than the width of the opening. The lower portion comprises a horizontal member, opposed elongate side walls extending downwardly and outwardly from the horizontal member, and a flange extending inwardly from each of the side walls. The inner ends of the flanges are spaced from each other to define an opening into an area defined by the side walls, the horizontal member, and the flanges. Each flange has an upper surface defining a channel, and the channels of the flanges are substantially parallel to each other.

The hanger comprises a hanger body adapted to be connected to a support member and a hanger coupling member extending downwardly from the hanger body. The hanger coupling member comprises a stem sized to pass through the opening of the slot in the rail segment upper portion and a footing having a width greater than the stem and sized to be slidingly received in the slot inner portion, whereby the hanger is slidably receivable in the rail segment upper portion and moveable along the rail segment upper portion.

In a variation, the rail segment includes a central portion between the upper and lower portions. The central portion comprises opposed walls which extend down from the upper portion, and a bottom extending between bottom edges of the middle portion walls; the central portion bottom being the horizontal member.

In accordance with an aspect of the rail system, the cross-sectional profile of the rail segment provides sufficient rigidity to the rail assembly, such that the rail assembly can be used without a truss assembly.

In accordance with an aspect of the rail system, the rail segment is made from a material, such that the rail segment will dynamically deflect under the forces of a fall. For example, the rail segment can be made from an aluminum alloy.

In accordance with an aspect of the rigid rail system, the rigid rail system further includes a connector for connecting two rail segments together. In a preferred embodiment, the connector is slidably received by the rail segment.

In accordance with an aspect of the connector, the connector comprises a base having a side-to-side width at least equal to a side-to-side width of the top portion of the rail segment; opposed side arms depending from opposite edges of the base which define a channel sized to receive the flange of the rail segment top portion; and a connector coupling member extending downwardly from the base.

In an embodiment of the rail segment, the slot of the rail segment top portion is defined by opposed upwardly extending arms and top plates on each of the arms. The opening to the slot is then being defined by inner edges of the top plates. The connector coupling member comprises a stem sized to pass through the opening of the slot in the rail segment upper portion and a footing having a width greater than the stem and sized to be slidingly received in the slot inner portion. The top plates extending beyond the arms to define outwardly extending flanges on the rail segments, and which are received in the channel formed in the connector.

In a preferred construction, the connector can slidingly receive two rail segments which abut each other between opposite ends of the connector.

In a preferred embodiment, the connector coupling member and the rail segment slot are both generally T-shaped.

In accordance with an aspect of the connector, the connector includes an upper portion defining an elongate slot comprised of an inner portion and an opening from a top surface of the connector into the inner portion. The connector's slot inner portion has a width greater than the width of the connector slot opening. The connector slot of the upper portion is shaped and configured to receive the coupling member of the hanger, whereby the hanger can be slidably received in the connector upper portion and moveable along the connector upper portion.

In accordance with an aspect of the connector, the connector can include opposed connector walls extending downwardly and outwardly from an end of the connector arms. The connector walls are positioned such that they are adjacent and substantially parallel to the walls of the rail segment lower portion when the connector is assembled to the rail segment.

The connector can include an enlarged end formation at a bottom of the connector walls. These enlarged end formations define a surface shaped to receive a junction between the rail segment lower portion wall and flange.

In an embodiment of the connector, the connector comprises an upper surface and side surface, which in combination, define an outer perimeter shaped and sized to be slidingly received in the rail segment.

In a variation, the connector can define an upwardly opening elongate slot comprised of an inner portion and an opening from a top surface of the connector into the inner portion, wherein the slot inner portion has a width greater than the width of the opening. The rail segment then can include a coupling member extending downwardly from a horizontal member of the rail segment. The rail segment coupling member comprising a stem sized to pass through the opening of the slot in the connector and a footing having a width greater than the stem and sized to be slidingly received in the slot inner portion.

In a variation of the rail segments, the rail segments include elongate ribs/flanges extending longitudinally along the inner surface of the rail segment walls. The connector then engages the ribs/flanges when received in the rail segment. In one version, the connector sits on the ribs/flanges. In another version, the connector includes elongate grooves in side walls of the connector; the grooves being sized and shaped to slidingly receive the ribs/flanges.

In another aspect of the rigid rail system, the system further includes a trolley to which a worker can connect a lanyard. The trolley comprises a trolley body having an elongate upper portion and a stem depending from the upper portion. The trolley stem is adapted to have a lanyard connected thereto. The body upper portion defines wheel mounts at opposite ends thereof and a wheel is rotatably mounted to each side of each of the wheel mounts. The wheels are mounted to the wheel mounts to rotate in a plane that is substantially parallel to the walls of the rail segment lower portion. Further, the wheels of each wheel mount are spaced apart such that the opposed wheels of the trolley ride in the channels of the rail segment lower portion.

In accordance with an aspect of the trolley, side walls or faces of the wheel mounts are sloped such that they define a plane that is substantially parallel to the plane of the walls of the rail segment lower portion when the trolley is received in the rail segment. The walls of the rail segment lower portion and the trolley wheels each define an angle with the vertical from about 10° to about 20°, or from about 12° to about 18°, or about 14°.

BRIEF DESCRIPTION OF THE DRAWINGS

FIGS. 10A-C are end elevational, side elevational, and perspective views of a body of a trolley;

FIGS. 11A-C are end elevational, side elevational, and perspective views of a trolley, including the trolley body with trolley wheels mounted to the body;

Corresponding reference numerals will be used throughout the several figures of the drawings.

DETAILED DESCRIPTION

Figure 1:
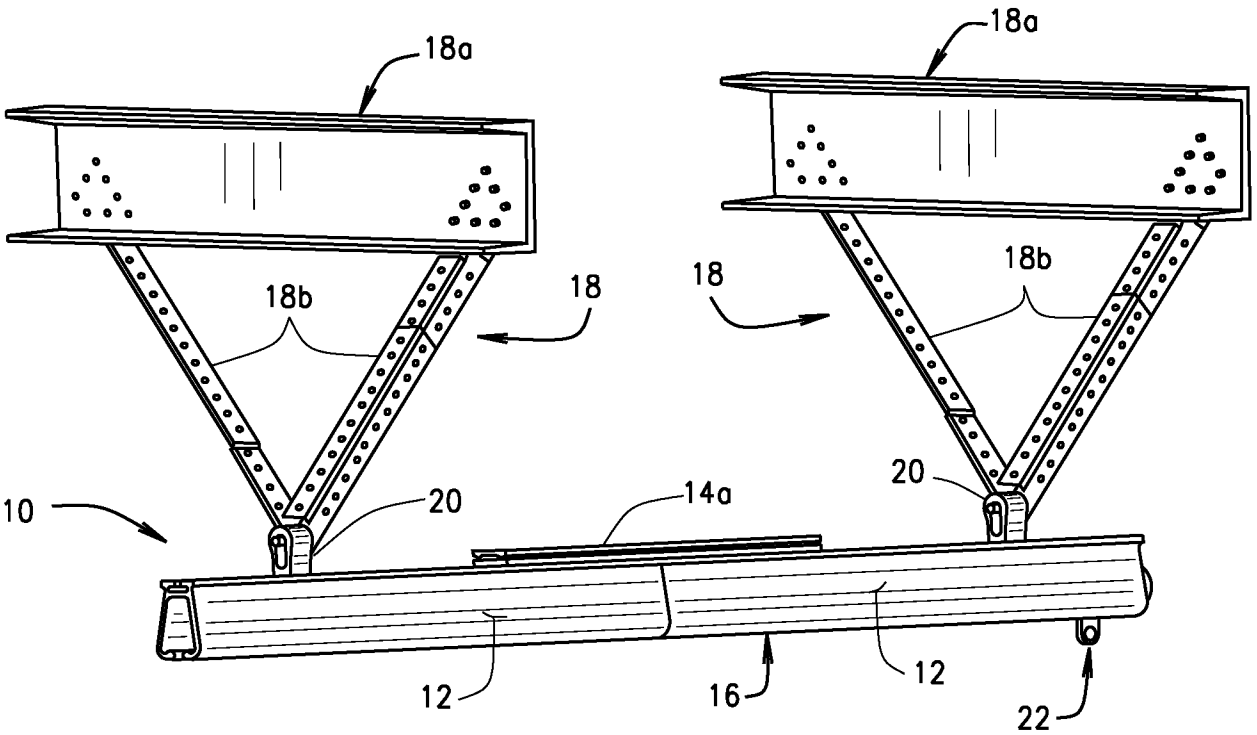
FIG. 1 is a perspective view of an illustrative rigid rail system suspended from support beams.
Figure 1A:
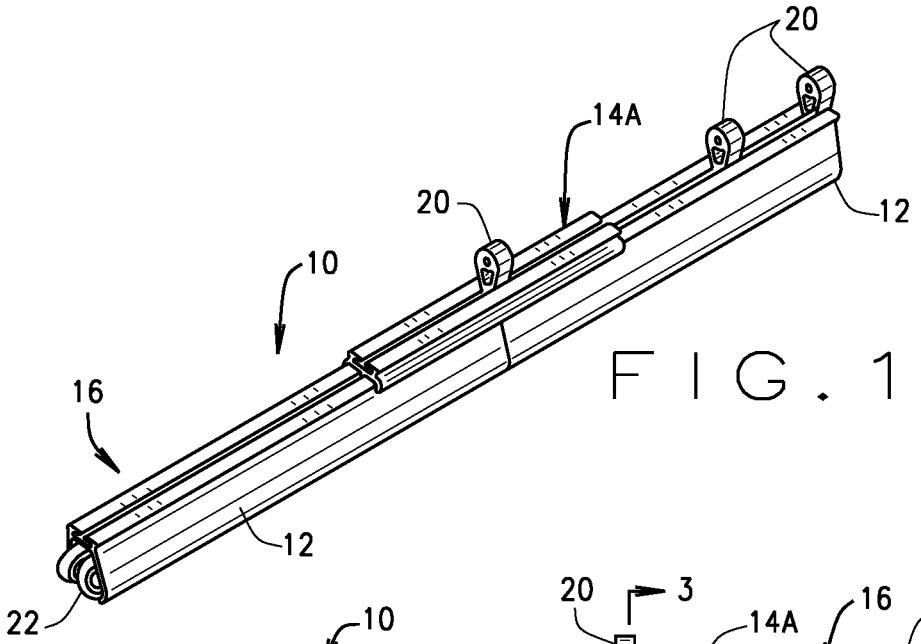
FIGS. 1A and 1B are perspective and side elevational views of a rigid rail system employing a short connector.
Figure 1B:
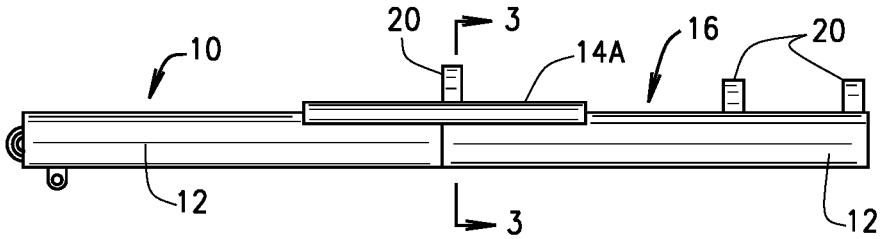
Figure 2A:
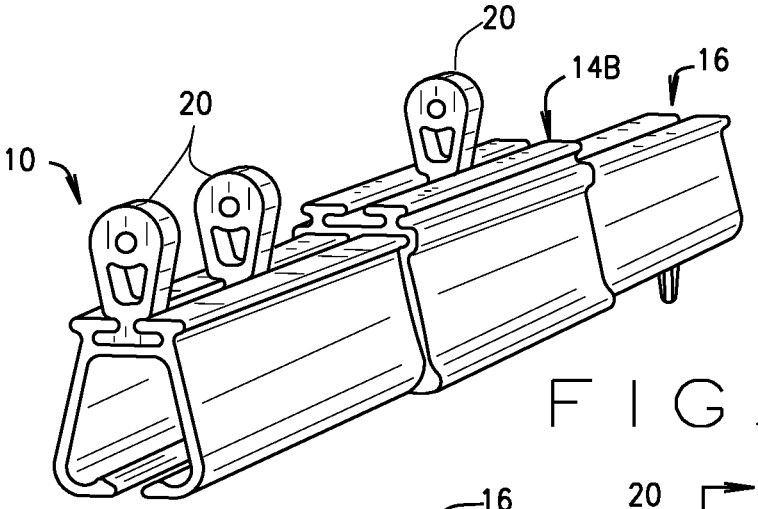
FIGS. 2A and 2B are perspective and side elevational views of a rigid rail system employing a tall connector.
Figure 2B:
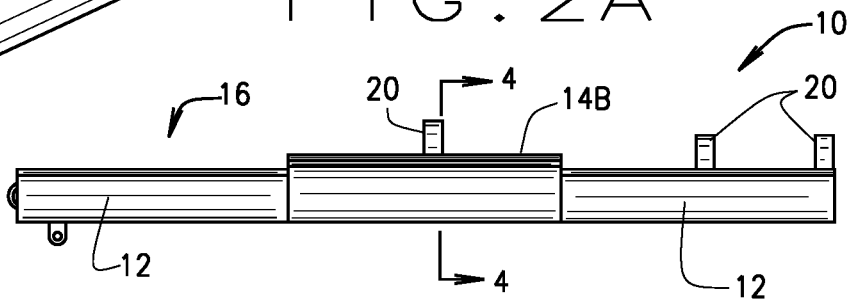

The following detailed description illustrates the claimed invention by way of example and not by way of limitation. This description will clearly enable one skilled in the art to make and use the claimed invention, and describes several embodiments, adaptations, variations, alternatives and uses of the claimed invention, including what I presently believe is the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

Turning to FIG. 1, a modular rigid rail system 10 comprises a plurality of rail segments 12 which are connected together by connectors or splices. The splice can either be a short connector 14*a* (FIGS. 1A-B, 3A-B, 8A-B) or a tall connector 14*b* (FIGS. 2A-B, 4A-B, 7A-B). The connected rail segments, in combination, form a rail assembly 16. The rail assembly 16 is suspended from supports 18 by means of hangers 20. In FIG. 1, the supports 18 comprise C-beams 18*a* which can extend between uprights (not shown) or other fixed anchor points, such as structural walls (not shown). L-brackets 18*b* extend between the C-beams 18*a* and the hangers 20. As shown, the L-brackets 18*b* extend diagonally from the C-beam 18*a* to the hanger 20, such that the L-brackets 18*b* and the C-beam 18*a* define a triangle. A trolley 22, to which a user's lanyard (preferably a self-retracting lanyard) is connected, rides along the rail assembly 16 to enable the user to move along the length of the structure on which the user is working.

Figure 5A:
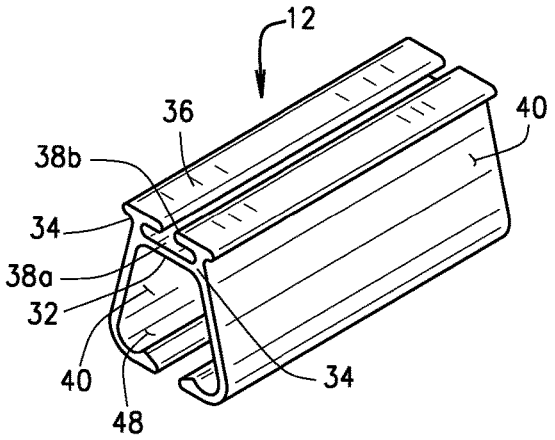
FIGS. 5A and 5B are fragmentary perspective and end elevational views of the rail segment of the rail assembly.
Figure 5B:
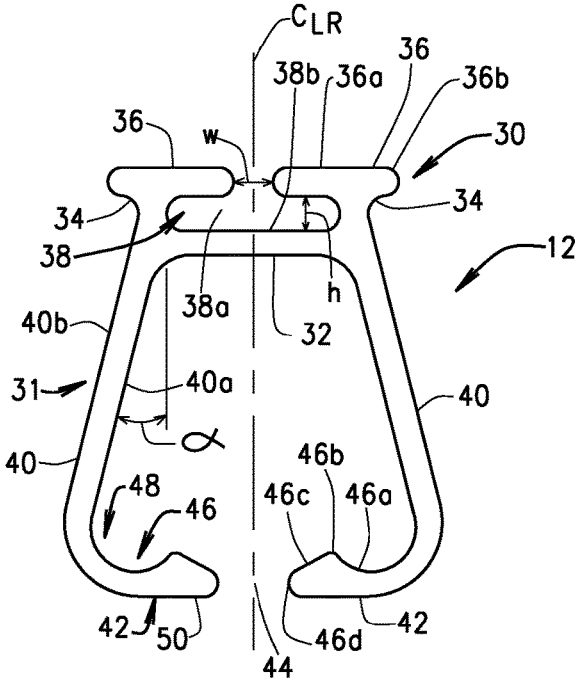

Turning to FIGS. 5A,B, the rail segment 12 comprises an upper portion 30 and a lower track forming portion 31. The upper portion 30 comprises a horizontal base member 32 with arms 34 extending upwardly from the opposite ends of the base member 32. A top plate 36 extends the length of each arm spaced above the base member 32. The top plates 36 are generally parallel to the base member 32. As seen, the top plates 36 each include an inner portion 36*a* which extends from the arm 34 towards a center line $C_{LR}$ of the rail segment 12, and an outer portion or flange 36*b* which extends away from the center line $C_{LR}$. The inner portion 36*a* is shown to be wider than the outer portion 36*b* (as measured from the middle of the arm 34 to the respective end of the top horizontal member). The inner ends of the top plate are spaced from the center line $C_{LR}$ of the rail segment, and the top plates 36 are spaced vertically above the horizontal member 32. The upper portion 30 therefor defines an elongate slot 38 which is generally T-shaped, and thus has a horizontal portion 38*a* and opening 38*b* to the horizontal portion between the inner ends of the top horizontal plates 36. Illustratively, the height h of the horizontal portion 38*a* of the slot can be about 1" (~2.54 cm), and the width w of the opening 38*b* can be about ¼" (~0.64 cm).

The lower portion 31 of the rail segment comprises opposed walls 40 which extend downwardly from the ends of the base member 32. As seen, the walls 40 and the arms 36 are co-linear and are effectively an extension of each other. A flange 42 extends inwardly from the bottom of each wall 40 toward the centerline $C_{LR}$. The flanges 42 do not extend all the way to the center line, and thus define a slot or opening 44 between them. At least the inner surface 40*a* of each wall defines an angle $\alpha$ with the vertical of between about 10° and about 20°, preferably from about 12° to about 18°, and most preferably about 14°. As seen in the FIGS. 5A,B, the outer surface 40*b* of each wall is parallel to the inner surface of the wall, such that the walls 40 have an approximately constant width. Illustratively, the walls can have a width between their inner and outer surfaces of about ½" (~1.3 cm). The flanges each have an inner surface 46 comprised of a radiused portion 46*a* which arcs inwardly from the end of the wall's inner surface 40*b*. The radiused portion 46 defines a track or channel 48 along which the trolley rides, as will be discussed below. The radiused portion 46*a* ends at a peak 46*b*, and a downwardly and inwardly sloping surface 46*c* extends from the peak to the end surface 46*d* of the flange 42. The bottom outer surface 49 of the flange is shown to be generally horizontal (i.e., generally perpendicular to the center line $C_{LR}$). Thus, the inner end of the flange 42 defines a thickened section of the finger.

Figure 6:
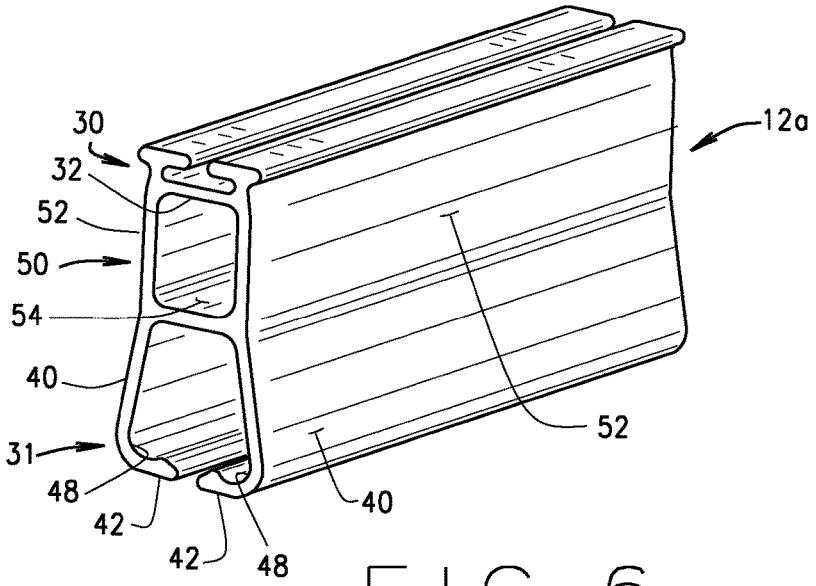
FIG. 6 is a perspective view of a second embodiment of a rail segment.
Figure 7A:
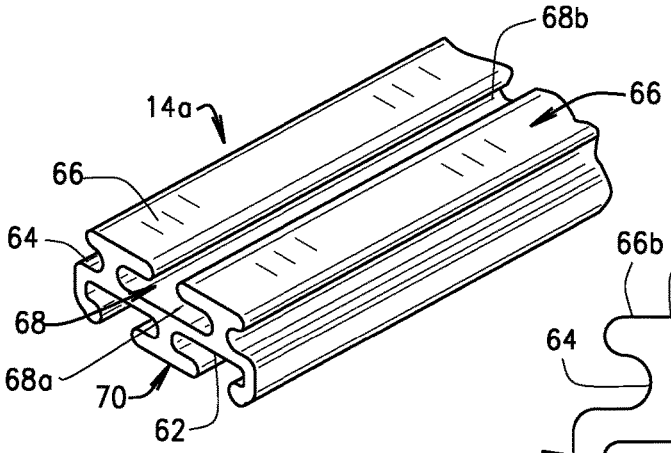
FIGS. 7A and 7B are a fragmentary perspective and end elevational views of a short connector used to join together two rail segments.
Figure 7B:
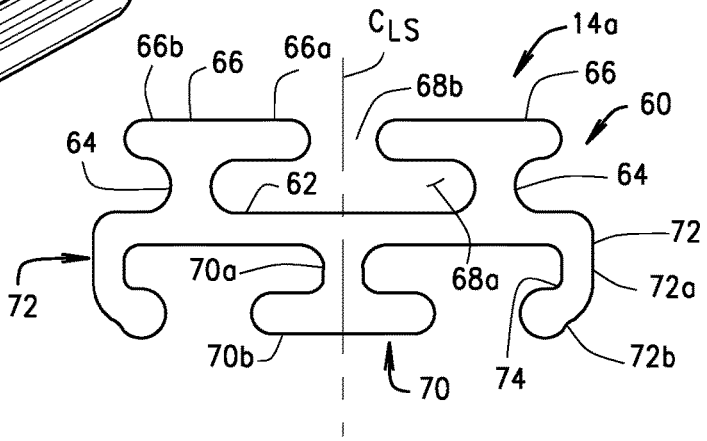
Figure 8A:
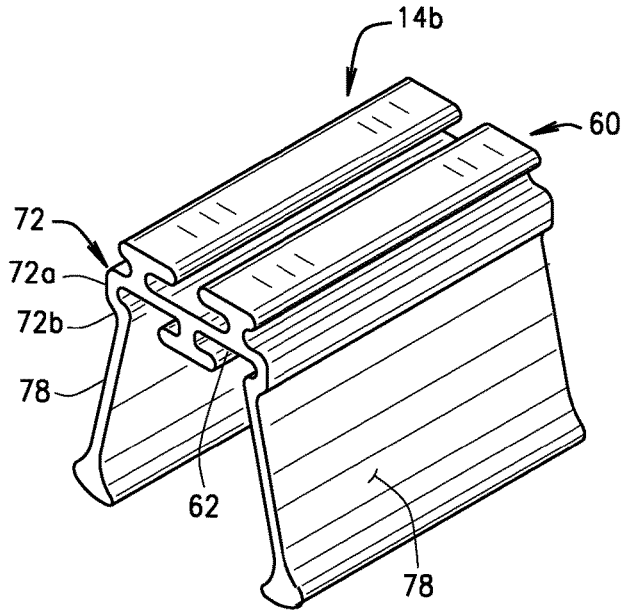
FIGS. 8A and 8B are a perspective and end elevational views of a tall connector used to join together two rail segments.
Figure 8B:
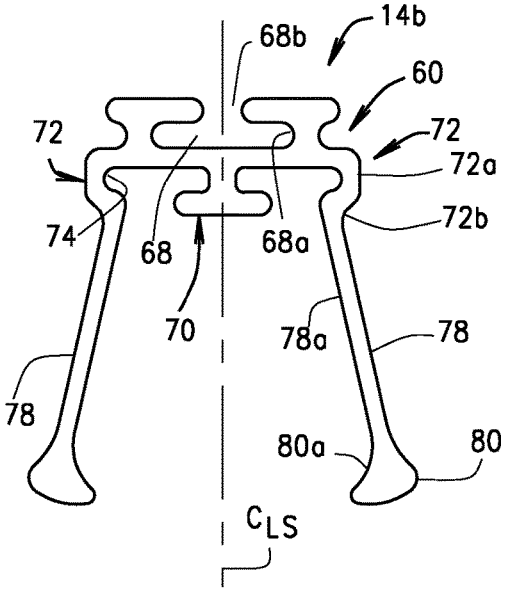

An alternative rail segment 12*a* is shown in FIG. 6. The rail segment 12*b* comprises a upper portion 30 and a lower portion 31 identical to the top and bottom portions 30 and 31 of the beam 12. These portions of the rail segment 12*b* thus need not be described. The rail segment 12*a* differs from the rail segment 12 in that the rail segment 12*a* includes a central section 50 between the upper portion 30 and the lower portion 31. This central section 50 comprises walls 52 which extend generally vertically from the ends of the upper portion base 32. A central section floor 54 extends between the bottom ends for the walls 52. The floor 54 is generally horizontal and generally parallel to the upper portion base 32. The walls 40 of the lower portion extend diagonally outwardly from the bottoms of the central section walls 52 and the outer ends of the central section floor 54. The central section 50 increases the structural rigidity of the rail segment, and thus allows for a single rail segment to span greater distances between supports 18. For example, the rail segment 12 (FIGS. 5A,B) may need to be supported about every 16½ feet (about every 5 m), and the rail segment 12*a* (FIG. 6) can extend about 33 feet (about 10 m) between supports.

As seen, the rail segment 12 has an end profile that is generally trapezoidal, and the rail segment 12*b* has a generally trapezoidal lower portion. The trapezoidal profile of the rail segments 12, 12*a* give the rail segments greater structural integrity, eliminating the need for a welded, reinforcing truss assembly.

The rail segments 12 and 12*a* are formed from a high-strength aluminum alloy, such as 6083-T6 aluminum alloys. The rail segments are preferably formed by an extrusion process, and as such, have a generally constant profile or vertical cross-section. This aluminum alloy provides for a rail segment that exhibits high strength yet is light wait. The rail segment has a weight of about 8 kg/meter (about 5.3 lbs/ft). Thus, for example, a 16' length of rail segment can weigh as little as about 85-88 lbs, and can be carried by a single person. Because the rail segment is extruded, it can be extruded (or an extruded rail segment can be cut) to any desired length.

In instances where the rail assembly 16 will comprise two or more rail segments 12, 12*a*, the rail segments are connected by either short connectors 14*a* or tall connectors 14*b*. As will become apparent, the tall connector 14*b* cannot be used, in the configuration shown, with the second rail segment 12*a*.

The short connector 14*a* and the tall connector 14*b* (FIGS. 7A,B and 8A,B, respectively) each comprise an upper portion 60 comprising a horizontal base member 62 with spaced apart arms 64 extending generally vertically upwardly from the base member 62. The arms 64 are preferably equidistant from a center line $C_{LS}$ of the splice 14*a*. A top plate 66 extends the length of each arm spaced above the base member 62. The top plates 66 are generally parallel to the horizontal base member 62. As seen, the top plates 66 each include an inner portion 66*a* which extends from the arm 64 towards a center line $C_{LS}$ of the connector, and an outer portion or flange 66*b* which extends away from the center line $C_{LS}$. The inner portion 66*a* is shown to be wider than the outer portion 66*b* (as measured from the middle of the arm 64 to the respective end of the top horizontal member). The inner ends of the top plates are spaced equidistantly from the center line $C_{LS}$, and the top plates 66 are spaced vertically above the base member 62. The upper portion 60 therefor defines an elongate slot 68, which like the rail segment slot 38 is generally T-shaped, and comprises a horizontal portion 68*a* and an opening 68*b* to the horizontal portion between the inner ends of the top plates 36. The dimensions of the T-slot 68 are preferably substantially identical to the dimensions of the T-slot 38 in the rail segment upper portion 30.

Each connector further includes a coupling member 70 which corresponds generally to the shape of the slot 38 of the rail segment 12, 12*a* to be received in the slot. The coupling member 70 is thus in the shape of an inverted T-flange extending downwardly from the underside of the base 62. To this end, the T-shaped coupler includes a stem 70*a* and a footing 70*b* which extend equidistantly from opposite sides of the stem. The T-flange 70 is sized to be received in the slot 38 of the rail segment upper portion 30. Additionally, each connector 14*a,b* includes outer fingers 72 which include a generally vertical portion 72*a* extending downwardly from the ends of the base 62 and a portion 72*b* that slopes inwardly from the bottom of the vertical portion 72*a*. The fingers 72 define an elongate slot or channel 74 which is sized to receive the outer portions/flanges 36*b* of the top plates 36 of the rail segment upper portion 30.

As seen in FIGS. 3A-4B, the footing 70*b* of the coupling member 70 has an edge-to-edge width that is shorter than the width of the horizontal portion 38*b* of the rail segment slot 38 and a height that allows for the footing 70*b* of the coupling member 70 to be slidingly received in the slot horizontal portion 38*b* without substantial play. Thus, the footing 70*b* is only slightly shorter than the height of the slot horizontal portion 38*b*. The coupling member stem 70*a* has a width shown to be slightly less than the width of the slot opening 38*b* and a length which will enable the coupling member footing 70*b* to be received in the horizontal portion 38*b* of the slot 38. As can be appreciated, the respective and complimentary shapes of the coupling member 70 and slot 38 prevent the coupling member from being pulled vertically out of the slot 38.

The connector 14*b* includes all the elements of the connector 14*a*, as described above. The connector 14*b* differs from the connector 14*a* in that it includes walls 78 which extend downwardly and outwardly from the inner ends from the fingers 72 (i.e., from the ends of the inwardly sloping section 72*b*). The walls 78 include enlarged portions 80 at their ends. The walls 78 have an inner surface 78*a* that transform into a concavely curved surface 80*a* at the enlarged end 80. The walls 78 have a height generally equal to the height of the walls 40 of the rail segment 12. Further, the curvature of the curved surface 80*a* conforms to the outer curvature of the rail segment walls, where the wall 40 transforms into the flange 42.

Figure 4A:
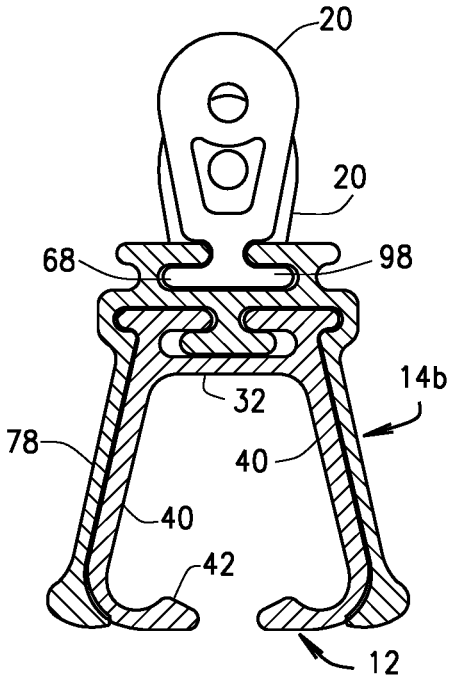
FIG. 4A is an end view of the rigid rail assembly of FIGS. 2A-B.
Figure 4B:
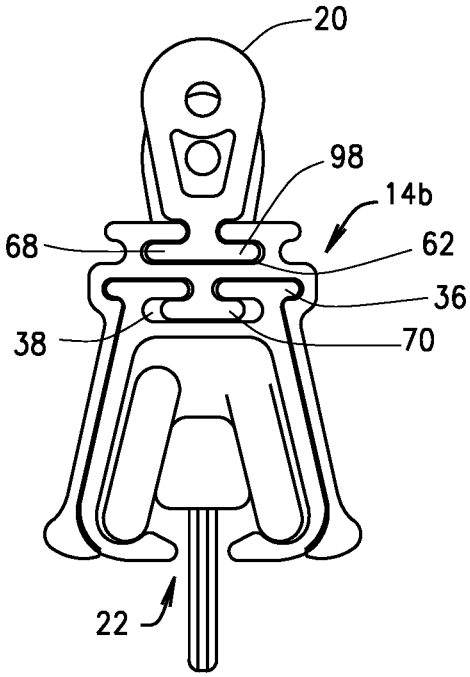
FIG. 4B is a cross-section of the rail assembly taken along line 4-4 of FIG. 2B.

To assemble two rail segments 12 together, a desired connector 14*a,b* is slid onto a first rail segment, such that the connector's coupling member 70 is received in the slot 38 of the first rail segment, and such that the outer portion/flange 36*b* of the top horizontal members 36 are received in the channels 74 of the connector. The connector is slid onto the rail segment, such that about one-half of the connector is on the first rail segment. A second rail segment is then slid into the first connector, such that the second rail segment's slot 38 receives the connector's coupling member and the top horizontal member outer portion/flange are received in the connector's side channels 74. The second segment is pushed on to the connector until the first and second rail segments are abutting each other such that their respective channels 46 are aligned and continuous. As seen in FIGS. 4A,B, when the connector 14*b* is used, the connector's walls 78 have a slope and length corresponding to the slope and length of the rail segment walls 40, and the distance between the connector walls 78 is such that the walls 40 of the rail segment 12 are sandwiched between the walls 78 of the connector. Further, as seen, the curved surface 80*a* of the connector wall 78 cradles the junction between the rail segment wall 40 and flange 42. There is thus a fitted connection between the connector 14*a* and the rail segment 12 which increases the rigidity of the rail segments at their ends. The use of the slot in the rail segment and the correspondingly shaped coupling member in the connector forms a fixed connection between the connector and rail segment. However, if desired, the position of the connectors to the rail segments can be further enhanced with set screws that extend, for example, through a desired point of the connector to impinge on the rail segment. Alternatively, wedges can be urged between the base 62 of the connector and the top plates 36 of the rail segment at opposite ends of the connector. As a further alternative, an epoxy adhesive can be applied to the connectors and/or the rail segments to fix the two elements together. To the best of our knowledge, epoxy adhesive has never been used to fix or join rail segments in a rigid rail fall protection system. As can be appreciated, the use of epoxy adhesive would greatly reduce the manufacturing and installation expense for a rigid rail fall protection system—especially as compared to a system in which the components are welded together, as is commonly done currently.

As can be appreciated, the connector 14*a* does not include a section that corresponds to the central section 50 of the rail segment 12*a*, and thus the connector 14*a* cannot be used with the rail segment 12*a*. However, the connector 14*a* could be modified to include a generally vertical leg section between the leg 78 and the inner end of the finger 72, such that a tall connector could be used with the rail segment 12*a*.

The connectors are preferably extruded from the same aluminum alloy as the rail segments, to thereby provide for a strong yet light weight connector. Because the connectors are extruded, they can be formed to any desired length. For example, the connectors can be formed in 12 m (about 39 feet) lengths for ease of transport to the installation site. At the installation site, the connectors can then be cut to desired lengths. For example, the connectors 14*a,b* can be cut to lengths of about one (1) foot for a supported splice, or several feet for an unsupported splice. A supported splice is formed when the connector is connected to the support 18 by means of a hanger 20. An unsupported splice would be formed where the connector 14 is not connected directly to the support by a hanger. Longer connectors can be used in cases were the span length of the rail segments 12, 12*a* needs to be increased or where the amount of deflection of the rail segment is to be reduced.

Figure 14:
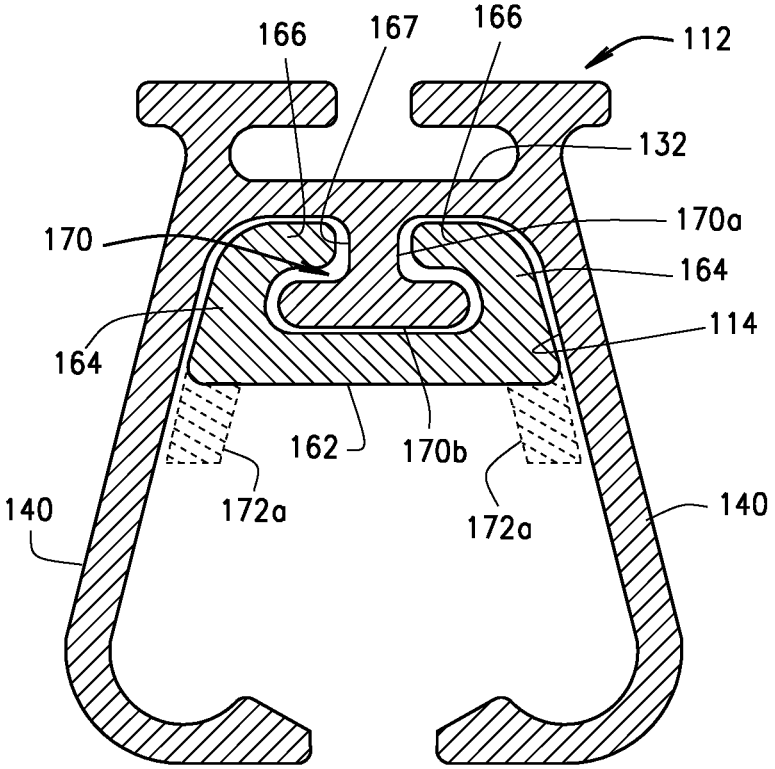
FIG. 14 is a schematic cross-sectional view of a rail segment and connector, wherein the connector is internal of, rather than external to, the rail segment.

The connectors 14*a,b* are designed to be received on the outside of the rail segments, and thus the connectors are visible when a rail system is assembled. In FIG. 14, a rail segment 112 and connector 114 are shown in which the connector is received inside of the rail segment, such that the connector 114 will not be readily visible in an assembled rail system. In this embodiment, the rail 112 is identical to the rail 12. However, it is provided with a coupling member 170 extending downwardly from the lower surface of the horizontal base member 132. The coupling member 170, like the coupling member 70 of the connector 14, includes a stem 170*a* and a footing 170*b*. The connector 114 would effectively be equivalent to the upper portion 60 of the coupler 14*a,b*. Thus, the connector 114 includes a connector base 162, arms 162 which extend upwardly from opposite ends of the base 162, and a top plate 164 extending inwardly from the arms 162. The top plate, arms, and base define an elongate slot 167 comprised of an inner portion sized and shaped to receive the footing 170*b* of the rail segment coupling member 170 and an opening into the inner portion sized to allow the coupling member stem 170*a* to extend therethrough. In this manner the connector 114 will be slidingly received in the interior of the rail segment 112. Because the connector 114 is received internally of the rail segment, the coupling member 70 of the connector 14*a,b* is not necessary, and is omitted. As seen, the connector forms an outer surface which corresponds generally to the shape or configuration of the interior surface of the rail segment.

If desired, the connector 114 can be provided with legs 172*a* (shown in dotted lines in FIG. 14) which extend downwardly and outwardly from the connector base 162 to be generally parallel to, and adjacent, the rail segment walls 140. If the connector legs 172*a* are to be used, length of the rail segment walls 140 may need to be lengthened to accommodate the trolley wheels.

As can be appreciated, the rail segment 12*a* (FIG. 6) can be similarly modified to use an internal connector. In the rail segment 12*a*, the coupling member 170 can depend from either the upper portion base member 32 or from the bottom 54 of the rail central portion 50.

Figure 15A:
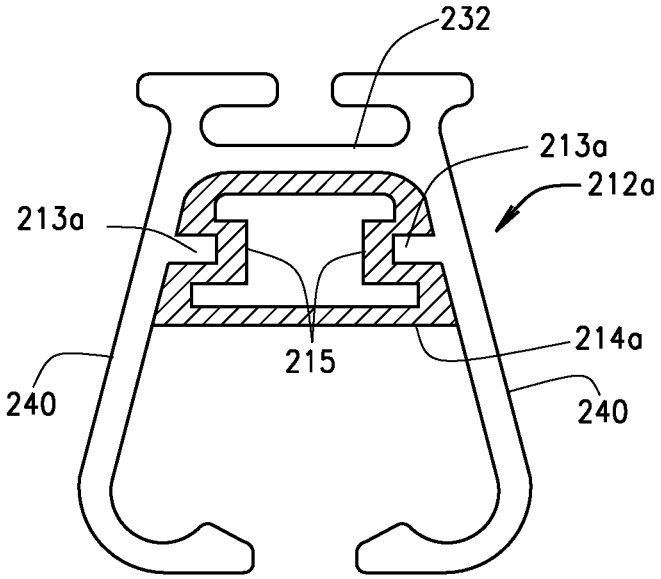
FIGS. 15A and 15B show two variations on an alternative internal connector.
Figure 15B:
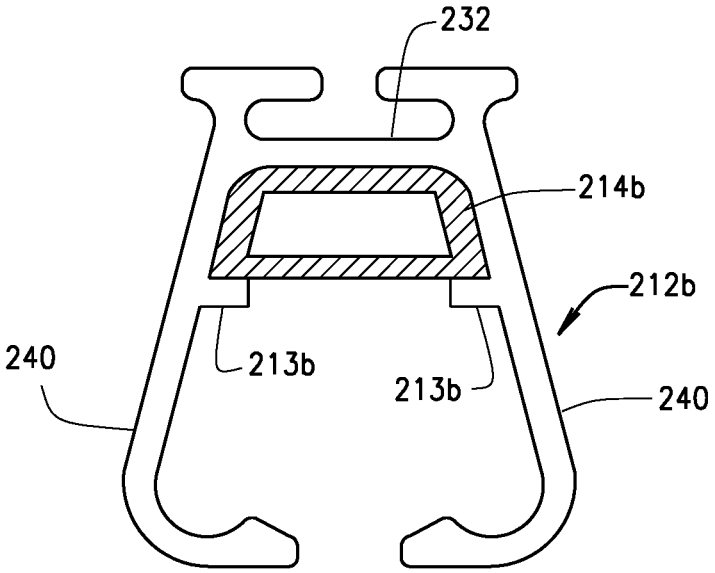

FIGS. 15A and 15B show two variations on an alternative internal connector, in which the T-shaped coupling member 170 is not needed. In these variations, the rail segments 212*a* and 212*b* are provided with elongate ribs or flanges 213*a,b* which extend inwardly from the inner surface of the rail segment wall 240. In each instance, the ribs/flanges 213*a,b* on the opposed walls are coplanar. In FIG. 15A, the ribs/flanges 213*a* are closer to the base 232 than are the ribs/flanges 213*b* in FIG. 15B. In FIG. 15A, the connector 214*a* is provided with a longitudinal slot extending along its opposed side walls. The slot will then receive the ribs 213*a* of the rail segment. In the rail segment 212*b*, the ribs/flanges 213*b*, as noted, are further from the horizontal base 232, and hence, the bottom surface of the connector can rest on the top surface of the ribs/flanges.

Figure 3A:
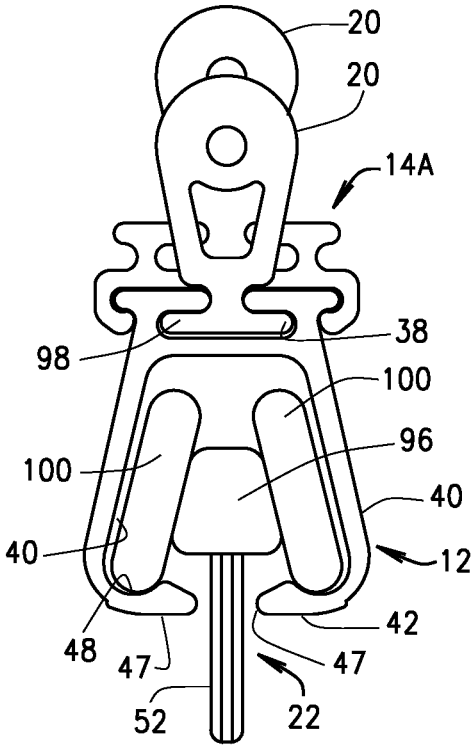
FIG. 3A is an end view of the rigid rail assembly of FIGS. 1A-B.
Figure 3B:
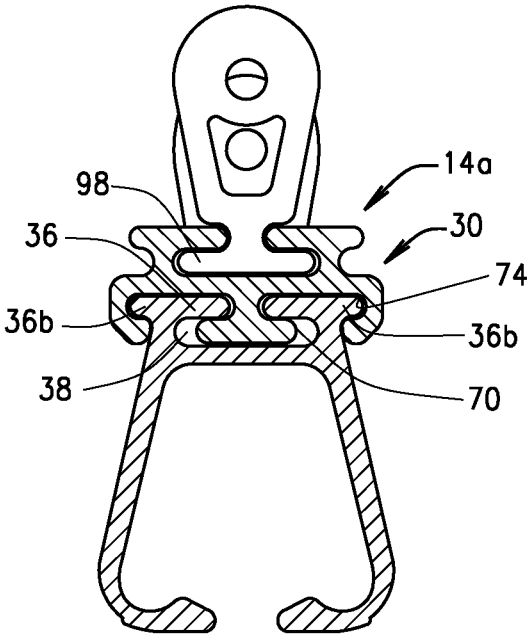
FIG. 3B is a cross-section of the rail assembly taken along line 3-3 of FIG. 1B.
Figure 9A:
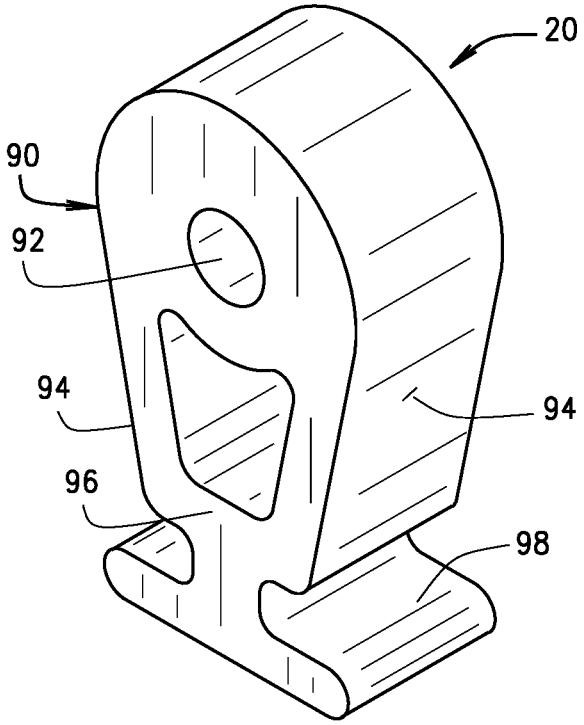
FIGS. 9A and 9B are perspective and end elevational views of a hanger used to suspend the rail segments from a support.
Figure 9B:
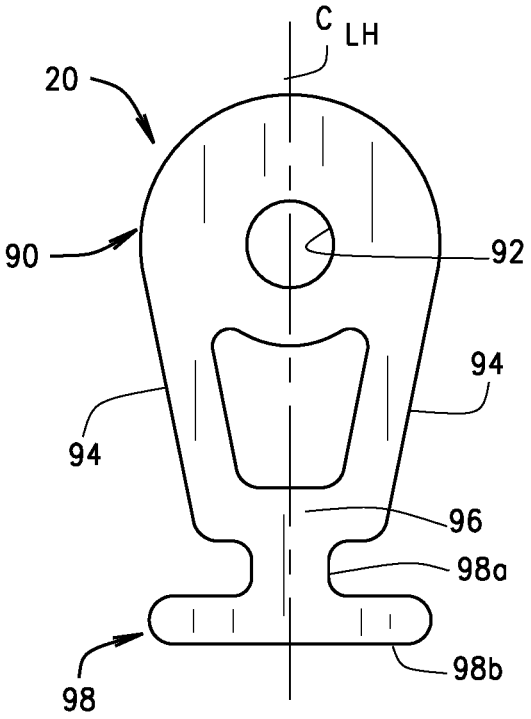

As noted above, a rail 16 is suspended from the supports 18 using a hanger. The hanger 20 is shown in detail in FIGS. 9A,B, the hanger 20 comprises a body 90 having an opening 92 generally in the center thereof. As shown, the body is generally cylindrical. A pair of opposed walls 94 extend downwardly and inwardly from a bottom portion of the body 90. For example, the bottom portion of the body between the opposed walls can define an arc of about 70° to about 80°, and preferably about 75°. A base 96 extends between the bottoms of the walls, and a coupling member 98 depends from the bottom of the base 96. Like the coupling member of the connector 14*a,b*, the coupling member 98 is generally in the shape of an inverted T and includes a stem 98*a* and a footing 98*b* which extends equidistantly from opposite sides of the stem. The coupling member 98 is sized to be received in either the slot 38 of the rail segment upper portion 30 or the slot 68 of the connector 14*a,b*. For example, FIG. 3A shows a coupling member of a hanger received in the slot of a rail segment, and FIG. 3B shows the coupling member of a hanger received in the slot of a connector. As seen in FIGS. 3A-4B, the footing 98*b* of the coupling member has an edge-to-edge width that is slightly shorter than the width of the slots 38 and 68 of the rail segment and connector, respectively. Further, the coupling member footing 98*b* has a height that allows for the footing to be slidingly received in the slot horizontal portions 38*b*, 68*b* without substantial play. Thus, the footing 98*b* is only slightly shorter than the height of the slot horizontal portion 38*b*, 68*b*. The flange stem 98*a* has a width shown to be slightly less than the width of the slot opening 38*b*, 68*b* and a top-to-bottom length which will enable the coupling member footing 98*b* to be received in the slot horizontal portion 38*b*, 68*b*. Because the hanger coupling member 98 can be received in either the rail segment's slot or the connector's slot, the two slots 38 and 68 are formed with substantially the same dimensions. As can be appreciated, the hanger is simply slid into the connector or rail segment slot, as may be necessary, and is moved along the slot to the desired position. An assembled rail assembly 16 can then be hoisted to raise the rail assembly 16 such that the hangers 20 are aligned with the support L-brackets 18*b*. Bolts are then passed through the hangers 20 and the L-brackets to suspend the rail assembly 16 from the supports 18. Typically, the weight of the rail segments and connectors will generate sufficient frictional force to prevent the rail assembly 16 from moving relative to the hangers 20. However, if desired, the position of the hangers relative to the rail assembly can be further fixed with, for example, set screws. Alternatively, an epoxy adhesive can be used to affix the hangers to the rail segment and/or the connector in the desired locations.

The rail segment and connector slots 38 and 68, and the connector and hanger coupling members 70 and 98 are shown to be generally T-shaped. It will be apparent that other shapes can be used. What is necessary is that the coupler footings 70*b* and 98*b* be wider than the stems 70*a* and 98*a*; that the slot portions 38*a* and 68*a* be wider than the openings 38*b* and 68*b*. Preferably, the footings 70*b* and 98*b* will also be shaped complementary to the slot portions 38*a* and 68*a*. Thus, for example, the horizontal slot portions 38*a*, 68*a* and the coupler member footings 70*b*, 98*b* could be circular, triangular (preferably as an inverted triangle), trapezoidal, etc.

The hangers 20 can be molded or extruded, and are preferably formed from the same aluminum alloy as the rail segments and the connectors. As with the connectors, the hangers can be extruded in long lengths (i.e., 12 m) to facilitate manufacture and delivery of the hangers to the installation site. At the installation site, hangers can then be cut from the extrusion as needed.

As can be appreciated, the rail system (i.e., the rail segments, connectors, and hangers) can be assembled without the need for any welding. This greatly reduces assembly time and installation costs.

Figure 12:
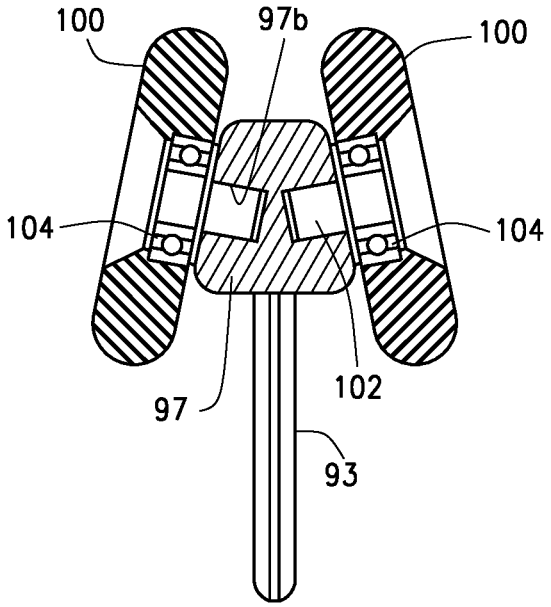
FIG. 12 is a cross-sectional view of a trolley taken along line 12-12 of FIG. 11B.

Lastly, as noted above, a trolley 22 moves along the rail assembly 16. The trolley, shown in detail in FIGS. 10A-13, comprises a generally T-shaped body 91 having a stem 93 and a cross-bar 95 extending across the top of the stem 93. The stem is generally centered relative to the cross-bar. The cross-bar has enlarged ends which define generally trapezoidal wheel mounts 97. The wheel mounts 97 have sloping side faces 97*a* which define an angle with the vertical substantially equal to the angle $\alpha$ defined by the rail segment walls 40. Thus, the side faces 97*a* define an angle with the vertical of between about 10° and about 20°, preferably from about 12° to about 18°, and most preferably about 14°. Axle bores 99 extend into the wheel mounts 97 from each of the side faces 97*a*. The axle bores 97*b* are generally perpendicular to the faces 97*a*, and thus slope diagonally inwardly, as best seen in FIG. 12. Wheels 100 are rotatably mounted on posts 102 preferably by means of bearings 104, such as sealed ball bearings. The posts 102 are friction fit into the bores 99 to rotatably secure the wheels to the wheel mounts 97.

When positioned in the rail assembly, the trolley stem 93 extends through the slot 44 between the fingers 42 of the rail segment. The trolley includes an opening 106 near the bottom of the stem 93 through which a clip (such as a carabineer) can pass to secure a lanyard to the trolley.

Preferably, the trolley body is forged from stainless steel. Currently, trolleys are cast or assembled from laminated stampings. The forged, stainless steel body will be considerably stronger and should have a greater useful life than current trolley bodies formed from cast or laminated stampings. The forged design allows the trolleys to be rapidly assembled for the sake of manufacturing efficiency and cost savings.

Figure 13:
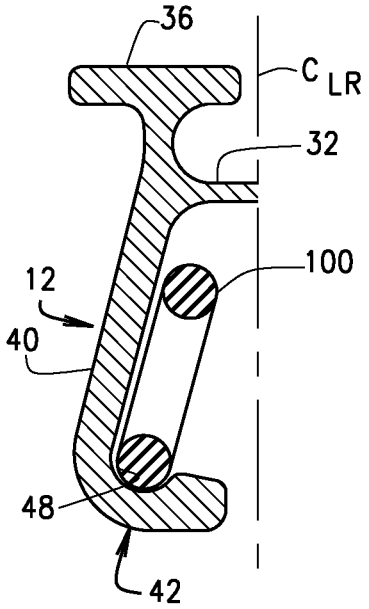
FIG. 13 is a fragmentary end view showing a trolley wheel positioned in a rail segment.

As seen in FIGS. 3A, 4A and 13, when the trolley 22 is placed on the rail, the wheels 100 ride in the track channel 48 on a plane generally parallel to the plane of the rail segment leg 40. The cantilevered trolley wheels 100 are mounted to the body 91 at an angle which matches the trapezoidal profile of the lower portion 31 on the rigid rail segment. This ensures that the trolley tracks straight and true for a smoother, more efficient operation of the trolley on the rail. The trapezoidal profile of the rail segments helps control the movement of the trolley 22 by creating an efficient guide for the trolley wheels 100, forcing the trolley wheels to run straight, as just noted, and with less frictional resistance than would typically exist in a box-channel. The bearings 102 assist in tracking efficiency of the trolley as the trolley moves along the rail. This helps increase the longevity of the trolley. Further, the rail segments form an enclosed or protected track or channel on which the trolleys run. This limits exposure of the trolley to the surrounding environmental conditions, thereby improving the reliability and function of the rolling or sliding mechanism of the trolley.

As can be appreciated by those of skill in the art, the rigid rail system 10 has several advantages over existing rail systems. As noted above, the components are light yet sturdy, and can be assembled without the need for welding. The modular nature of the components allows for increased adaptability in designing and installing rail systems, and provides for an "building-block" style approach to component design. The rail profile is modular and the material (aluminum alloy) is easy to work with. Field installation teams can easily cut segments of extruded rail segments and connectors to the desired length and assemble them based on the needs of the specific installation, reducing the amount of customizing operations required at the point of manufacture. This further reduces installation cost/complexity while simultaneously reducing manufacturing costs and increasing stock-keeping efficiencies.

The trapezoidal profile of the rail segment with the trolley channel on the bottom allows the use of one, two, or more trolleys along the length of a rail assembly. The T-slot on the top of the rail segment allows multiple rail segments to be spliced together with the connectors. Both the connectors and the rail segments accept the same hangers 20 which fix the rigid rail fall arrest system 10 to the structural anchorages 18. This greatly reduces the variety of tools and hardware required to assemble and install a rail system. Furthermore, it allows for adaptation to an unlimited number of clamping configurations for adaptations to virtually any type of structural anchorage.

The use of the aluminum alloy increases corrosion-resistance and eliminates the need for costly galvanization and/or powder-coating operations, thereby improving lifespan and addressing the needs of outdoor or harsh-environment installations.

Extruding the rail segments, connectors, and hangers increases the efficiency of the manufacturing process and eliminates the stock building needed for "build-to-order" customization which is common-place in the rigid rail system market. The result is that what would typically be a costly, customized solution can be offered virtually off-the-shelf and made mainstream for users that would otherwise not be able to wait, or would not be able to afford a solution of this type.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense. For example, the connector 14*a,b* could be formed without the upper portion 60. In this instance, the connector could be used to connect adjacent rail segments, but it would not include the slot, and thus the hangers 20 could only be used with the rail segments. The wheel mounts of the trolley could be formed with straight side walls (so that the wheel mount is rectangular, rather than trapezoidal). In this instance, the bores would need to define an angle with the side walls of the wheel mounts, so that the wheels, when mounted to the wheel mount will rotate in a plane substantially parallel to the walls 40 of the rail segment lower portion 31. These examples are merely illustrative.

The invention claimed is:

1. A rigid rail assembly for a fall protection system; the rigid rail assembly comprising a rail segment and a hanger:

the rail segment comprising an upper portion and a lower portion;

the rail segment upper portion defining an elongate slot comprised of an inner portion and an opening from a top surface of the rail segment into the inner portion; the slot inner portion having a width greater than a width of the opening;

the lower portion comprising a horizontal member, opposed elongate side walls extending downwardly and outwardly from the horizontal member, and a flange extending inwardly from each of the side walls; an inner end of each said flange being spaced from each other to define an opening into an area defined by the side walls, the horizontal member, and the flanges; each flange having an upper surface defining a channel, the channels of the flanges being substantially parallel to each other;

the hanger comprising a hanger body adapted to be connected to a support member and a hanger coupling member extending downwardly from the hanger body; the coupling member comprising a stem sized to pass through the opening of the slot in the rail segment upper portion and a footing having a width greater than the stem and sized to be slidingly received in the slot inner portion, whereby the hanger is slidably receivable in said rail segment upper portion and moveable along said rail segment upper portion; and said rigid rail system further including a connector for connecting two rail segments together; said connector being slidably received by said rail segment.

2. The rigid rail system of claim 1 wherein said rail segment includes a central portion between said upper and lower portions; said central portion comprising opposed walls which extend down from said upper portion, and a bottom extending between bottom edges of said middle portion walls; said central portion bottom being said horizontal member.

3. The rigid rail system of claim 1 wherein the cross-sectional profile of said rail segment provides sufficient rigidity to said rail assembly, such that said rail assembly can be used without a truss assembly.

4. The rigid rail system of claim 1 wherein said rail segment is made from a material, such that the rail segment will dynamically deflect under the forces of a fall.

5. The rigid rail system of claim 4 wherein said rail segment is made from an aluminum alloy.

6. The rigid rail system of claim 1 wherein said slot of said rail segment upper portion is defined by opposed arms extending upwardly from an upper portion base and top plates on each of said arms; said opening to said slot being defined by inner edges of the top plates; said top plates extending beyond said arms to define flanges;

wherein said connector comprises a base having a side-to-side width at least equal to a side-to-side width of the top portion of said rail segment; opposed side arms depending from opposite edges of said base and defining a channel sized to receive said flange of said rail segment top portion; and a connector coupling member extending downwardly from said base; said connector coupling member comprising a stem sized to pass through the opening of said slot in said rail segment upper portion and a footing having a width greater than said stem and sized to be slidingly received in said slot inner portion; and whereby, said connector can slidingly receive two rail segments which abut each other between opposite ends of said connector.

7. The rigid rail system of claim 1 wherein said connector coupling member and said rail segment slot are both generally T-shaped.

8. The rigid rail system of claim 1 wherein said connector further includes an upper portion defining an elongate slot comprised of an inner portion and an opening from a top surface of said connector into said inner portion; said slot inner portion having a width greater than the width of said opening; said slot of said upper portion being shaped and configured to receive the coupling member of said hanger, whereby said hanger is slidably receivable in said connector upper portion and moveable along said connector upper portion.

9. The rigid rail system of claim 1 wherein said connector further comprises opposed connector walls extending downwardly and outwardly from an end of said connector arms; said connector walls being positioned such that they are adjacent and substantially parallel to the walls of the rail segment lower portion when said connector is assembled to the rail segment.

10. The rigid rail system of claim 1 wherein said connector further includes an enlarged end formation at a bottom of said connector walls; said enlarged end formations defining a surface shaped to receive a junction between said rail segment lower portion wall and flange.

11. The rigid rail system of claim 1 wherein said connector comprises an upper surface and side surface; said upper and side surfaces defining an outer perimeter shaped and sized to be slidingly received in said rail segment.

12. The rigid rail system of claim 11 wherein said connector defines an upwardly opening elongate slot comprised of an inner portion and an opening from a top surface of said connector into said inner portion; said slot inner portion having a width greater than the width of said opening; and wherein said rail segment comprises coupling member extending downwardly from a horizontal member of said rail segment; said coupling member comprising a stem sized to pass through the opening of said slot in said connector and a footing having a width greater than said stem and sized to be slidingly received in said slot inner portion.

13. The rigid rail system of claim 11 wherein said rail segment includes elongate ribs/flanges extending longitudinally along the inner surface of said rail segment walls, whereby said connector engages said ribs/flanges when received in said rail segment.

14. The rigid rail system of claim 13 wherein said connector sits on said ribs/flanges.

15. The rigid rail system of claim 13 wherein said connector includes elongate grooves in side walls of said connector; said grooves being sized and shaped to slidingly receive said ribs/flanges.

16. The rigid rail system of claim 1 further including a trolley; said trolley comprising a trolley body having an elongate upper portion and a stem depending from said upper portion; said stem being adapted to have a lanyard connected thereto; said body upper portion defining wheel mounts at opposite ends thereof and having a wheel rotatably mounted to each side of each of said wheel mounts; said wheels being mounted to said wheel mounts to rotate in a plane that is substantially parallel to the walls of said rail segment lower portion; said wheels of each wheel mount being spaced apart such that the opposed wheels of said trolley ride in said channels of said lower portion.

17. A rigid rail assembly for a fall protection system; the rigid rail assembly comprising a rail segment and a hanger:

the rail segment comprising an upper portion and a lower portion;

the rail segment upper portion defining an elongate slot comprised of an inner portion and an opening from a top surface of the rail segment into the inner portion; the slot inner portion having a width greater than a width of the opening;

the lower portion comprising a horizontal member, opposed elongate side walls extending downwardly and outwardly from the horizontal member, and a flange extending inwardly from each of the side walls; an inner end of each said flange being spaced from each other to define an opening into an area defined by the side walls, the horizontal member, and the flanges; each flange having an upper surface defining a channel, the channels of the flanges being substantially parallel to each other; and the hanger comprising a hanger body adapted to be connected to a support member and a hanger coupling member extending downwardly from the hanger body; the coupling member comprising a stem sized to pass through the opening of the slot in the rail segment upper portion and a footing having a width greater than the stem and sized to be slidingly received in the slot inner portion, whereby the hanger is slidably receivable in said rail segment upper portion and moveable along said rail segment upper portion;

the rigid rail system of further including a trolley; said trolley comprising a trolley body having an elongate upper portion and a stem depending from said upper portion; said stem being adapted to have a lanyard connected thereto; said body upper portion defining wheel mounts at opposite ends thereof and having a wheel rotatably mounted to each side of each of said wheel mounts; said wheels being mounted to said wheel mounts to rotate in a plane that is substantially parallel to the walls of said rail segment lower portion; said wheels of each wheel mount being spaced apart such that the opposed wheels of said trolley ride in said channels of said lower portion; said sides of said wheel mounts being sloped to define a plane that is substantially parallel to the plane of said walls of said rail segment lower portion when said trolley is received in said rail segment.

18. A rigid rail assembly for a fall protection system; the rigid rail assembly comprising a rail segment and a hanger:

the rail segment comprising an upper portion and a lower portion;

the rail segment upper portion defining an elongate slot comprised of an inner portion and an opening from a top surface of the rail segment into the inner portion; the slot inner portion having a width greater than a width of the opening;

the lower portion comprising a horizontal member, opposed elongate side walls extending downwardly and outwardly from the horizontal member, and a flange extending inwardly from each of the side walls; an inner end of each said flange being spaced from each other to define an opening into an area defined by the side walls, the horizontal member, and the flanges; each flange having an upper surface defining a channel, the channels of the flanges being substantially parallel to each other; and the hanger comprising a hanger body adapted to be connected to a support member and a hanger coupling member extending downwardly from the hanger body; the coupling member comprising a stem sized to pass through the opening of the slot in the rail segment upper portion and a footing having a width greater than the stem and sized to be slidingly received in the slot inner portion, whereby the hanger is slidably receivable in said rail segment upper portion and moveable along said rail segment upper portion;

the rigid rail system of further including a trolley; said trolley comprising a trolley body having an elongate upper portion and a stem depending from said upper portion; said stem being adapted to have a lanyard connected thereto; said body upper portion defining wheel mounts at opposite ends thereof and having a wheel rotatably mounted to each side of each of said wheel mounts; said wheels being mounted to said wheel mounts to rotate in a plane that is substantially parallel to the walls of said rail segment lower portion; said wheels of each wheel mount being spaced apart such that the opposed wheels of said trolley ride in said channels of said lower portion; the walls of said rail segment lower portion and said trolley wheels each defining an angle with the vertical from about 10° to about 20°.

19. The rigid rail system of claim 18 wherein the walls of said rail segment lower portion and said trolley wheels each define an angle with the vertical from about 12° to about 18°.

20. The rigid rail system of claim 18 wherein the walls of said rail segment lower portion and said trolley wheels each define an angle with the vertical of about 14°.

* * * * *